US008696316B2

(12) United States Patent
Decker et al.

(10) Patent No.: US 8,696,316 B2
(45) Date of Patent: Apr. 15, 2014

(54) LOW BLADE FREQUENCY TITANIUM COMPRESSOR WHEEL

(75) Inventors: David Decker, Arden, NC (US); Stephen Roby, Asheville, NC (US)

(73) Assignee: Borg Warner Inc., Auburn Hills, MI (US)

( * ) Notice: Subject to any disclaimer, the term of this patent is extended or adjusted under 35 U.S.C. 154(b) by 755 days.

(21) Appl. No.: 12/741,845

(22) PCT Filed: Nov. 14, 2008

(86) PCT No.: PCT/US2008/083624

§ 371 (c)(1), (2), (4) Date: May 7, 2010

(87) PCT Pub. No.: WO2009/065030

PCT Pub. Date: May 22, 2009

(65) Prior Publication Data

US 2010/0263373 A1 Oct. 21, 2010

Related U.S. Application Data

(60) Provisional application No. 60/988,673, filed on Nov. 16, 2007.

(51) Int. Cl.

| | |
|---|---|
| ***F04D 29/38*** | (2006.01) |
| ***F04D 29/42*** | (2006.01) |
| ***F04D 29/66*** | (2006.01) |
| ***F04D 29/02*** | (2006.01) |

(52) U.S. Cl.
USPC ..... 416/223 B; 415/119; 416/500

(58) Field of Classification Search
USPC ..... 416/175, 182, 185, 223 B, 500; 415/119, 206
See application file for complete search history.

(56) References Cited

U.S. PATENT DOCUMENTS

| | | | | |
|---|---|---|---|---|
| 3,758,233 | A * | 9/1973 | Cross et al. | 416/229 R |
| 4,505,764 | A * | 3/1985 | Smickley et al. | 148/670 |
| 5,269,658 | A * | 12/1993 | Carlson et al. | 416/229 R |
| 5,482,437 | A | 1/1996 | Houston et al. | |
| 5,490,759 | A * | 2/1996 | Hoffman | 415/10 |
| 5,988,982 | A * | 11/1999 | Clauer | 416/241 R |
| 6,679,121 | B2 * | 1/2004 | Sonnichsen et al. | 73/660 |
| 7,033,131 | B2 * | 4/2006 | Schreiber | 415/12 |
| 7,070,390 | B2 * | 7/2006 | Powell | 416/224 |
| 7,278,461 | B2 * | 10/2007 | Endo et al. | 164/76.1 |
| 2002/0090302 | A1 * | 7/2002 | Norris et al. | 416/224 |

(Continued)

FOREIGN PATENT DOCUMENTS

| | | |
|---|---|---|
| JP | 2004052754 | 2/2004 |
| KR | 977004104 | 8/1997 |
| KR | 1020010052416 | 6/2001 |
| KR | 20070088494 | 8/2007 |

*Primary Examiner* — Nathaniel Wiehe
*Assistant Examiner* — Joshua R Beebe
(74) *Attorney, Agent, or Firm* — Miller Canfield

(57) ABSTRACT

A compressor wheel (20) for an air boost device and a method for designing the wheel are provided. The compressor wheel (20) comprises a hub (24) and a plurality of blades (22, 23) connected to the hub (24). The plurality of blades (22, 23) have a ratio (f/N) of natural frequency to maximum rotational speed of less than 4.0 and are made from a titanium alloy. The plurality of blades (22, 23) can comprise a plurality of full blades (22) and a plurality of splitter blades (23).

11 Claims, 8 Drawing Sheets

(56) References Cited

U.S. PATENT DOCUMENTS

2004/0062645 A1* 4/2004 Decker et al. ..... 415/200
2004/0208741 A1* 10/2004 Barb ..... 415/119
2006/0078432 A1* 4/2006 Darolia et al. ..... 416/241 R
2006/0104816 A1* 5/2006 Kraemer et al. ..... 416/185
2010/0021305 A1* 1/2010 Martensson ..... 416/186 R
2012/0148412 A1* 6/2012 Decker ..... 416/223 A

* cited by examiner

LOW BLADE FREQUENCY TITANIUM COMPRESSOR WHEEL

FIELD OF THE INVENTION

The present invention concerns air boost devices and in particular a compressor wheel capable of operating at high RPM with acceptable aerodynamic performance and operating life. Further, it allows a compressor wheel to be designed with greater aerodynamic efficiency, without sacrificing operating life, particularly high cycle fatigue (HCF) safety.

DESCRIPTION OF THE RELATED ART

Air boost devices (turbochargers, superchargers, electric compressors, etc.) are used to increase combustion air throughput and density, thereby increasing power and responsiveness of internal combustion engines. Air boost devices, such as turbochargers, are widely used on internal combustion engines, and in the past have been particularly used with large diesel engines, especially for highway trucks and marine applications, and in passenger cars. Compressor wheels are found some superchargers, which derive their power directly from the crankshaft of the engine, as well as turbochargers, which are driven by the engine exhaust gases.

More recently, in addition to use in connection with large diesel engines, turbochargers have become popular for use in connection with smaller, passenger car power plants. The use of a turbocharger in passenger car applications permits selection of a power plant that develops the same amount of horsepower from a physically smaller, lower mass engine. Using a lower mass engine has the desired effect of decreasing the overall weight of the car, increasing sporty performance, while a smaller engine enables reduces vehicle frontal area, reducing the aerodynamic drag of the vehicle improving the fuel economy.

Turbochargers, in growing numbers, are being applied in configurations of multiple stages. Many of today's applications are regulated two stage turbochargers in which the low pressure compressor stage provides heated air to the inlet of the high pressure stage compressor. For the purpose of this application these multiple stage turbochargers are dealt with as multiples of a single turbocharger application.

FIG. 1 depicts a typical turbocharger. Exhaust gas from an engine is delivered to the foot (51) of the turbine housing (2), to drive a turbine wheel (70). The turbine wheel is connected to a shaft (71) which is supported within a bearing housing (3). The bearing housing is supported by the turbine housing (2) on one end, and by the compressor cover (10) on the other end. The shaft (71) is connected to a compressor wheel (20). The compressor wheel (20) draws air typically filtered by an air filter is drawn into the compressor cover (10) through the compressor inlet (11) though a variety of inlet ducts peculiar to each vehicle/engine installation. The incoming air is compressed by the rotation of compressor wheel (20) in the compressor cover (10) and discharged to the inlet side of the engine through the compressor discharge (12).

The design and function of turbochargers are described in detail in the prior art, for example, U.S. Pat. Nos. 4,705,463, 5,399,064, and 6,164,931, the disclosures of which are incorporated herein by reference.

Turbocharger compressors consist of three fundamental components: compressor wheel, diffuser, and housing. The compressor stage works by drawing air, from an air cleaner, into the compressor housing inlet axially, accelerating the air to high tangential and radial velocity through the rotational speed of the wheel, and expelling this air, which still has substantial kinetic energy, in a radial direction through the diffuser. The diffuser slows down the high-velocity air, recovering as much of this energy as possible, increasing the pressure and the temperature of the air. The diffuser can be formed by the compressor backplate, on one side, and the compressor cover on the opposite side, with the side wall being formed by either component. The volute then collects the air and slows it down before it reaches the compressor exit. The blades of a compressor wheel have a highly complex shape, for (a) drawing air in axially, (b) accelerating it centrifugally, and (c) discharging air radially outward at an elevated pressure and temperature, into the diffuser and then the volute.

The operating behavior of a compressor within a turbocharger may be graphically illustrated by a "compressor map" associated with the turbocharger in which the pressure ratio (compression outlet pressure divided by the inlet pressure) is plotted on the vertical axis and the flow is plotted on the horizontal axis. In general, the operating behavior of a compressor wheel is limited on the left side of the compressor map by a "surge line" and on the right side of the compressor map by a "choke line." The surge line basically represents "stalling" of the airflow at the compressor inlet. As air passes through the air channels between the blades of the compressor impeller, boundary layers build up on the blade surfaces. These low momentum masses of air are considered a blockage and loss generators. When too small a volume flow and too high of an adverse pressure gradient occurs, the boundary layer can no longer adhere to the suction side of the blade. When the boundary layer separates from the blade, stall and reversed flow occurs. Stall will continue until a stable pressure ratio, by positive volumetric flow rate, is established. However, when the pressure builds up again, the cycle will repeat. This flow instability continues at a substantially fixed frequency, and the resulting behavior is known as "surging." The phenomenon of surge is quite violent causing rapid changes of speed and load reversals in the turbocharger, the result of which is often destruction of the turbocharger.

The "choke line" represents the maximum centrifugal compressor volumetric flow rate as a function of the pressure ratio, which is limited for instance by the minimal cross-section of the channel between the blades, called the throat. When the flow rate at the compressor inlet or other throat location reaches sonic velocity, no further flow rate increase is possible and choking results. Surge must be avoided and choking of a compressor should be avoided.

Recently, tighter regulation of engine exhaust emissions has led to an interest in even higher pressure ratio boosting devices. However, current compressor wheels are not capable of withstanding the stresses involved in the generation of higher pressure ratios (>3.8). While aluminum is a material of choice for compressor wheels due to low weight (with resultant low inertia) low material cost, and relatively low fabrication costs, the temperature and stresses due to operation at high speed (RPM), exceed the capability of conventionally employed aluminum alloys.

Refinements have been made to aluminum compressor wheels, in both foundry practices and the material properties of the base material, but due to the inherent limited strength, at temperature, of cast aluminum, no further significant improvements can be expected. Accordingly, high pressure ratio boost devices have been found in practice to have unacceptably short life. The normal practice for compressor wheels is for them to be used in service for several rebuild periods of a turbocharger's life. This limitation in compressor wheel life causes high maintenance cost, and thus has too high a product life cost for widespread acceptance.

Failures of compressor wheels typically are of three types: hub stress related, backwall related, and blade frequency related. Hub stress related and backwall related failures are referred to as low cycle fatigue (LCF) failures and are often due to alternating stresses caused by the wheel speed varying due to the operation of the engine, for example where the vehicle engine speed is repeatedly changing, for example, during gear changes.

Blade frequency related failures are referred to as high cycle fatigue (HCF) failures and often occur when aerodynamic forces acting on the compressor blades make the wheel resonate to an undesirable extent. With each resonant cycle, the blades are deflected from their natural shape, being bent backwards and forwards, with no dissipation of the vibrational energy. Repeated bending or deflection leads to material fatigue, cracking and an ultimate fracture. The compressor blade can be excited by a pure order-related phenomenon or excitation caused by a feature in the compressor inlet or diffuser. The blade frequency related failure can be dependent on whether an integral multiple of operating speeds of the compressor wheel are co-incident with the natural frequency of the compressor wheel blades.

Impellers, including compressor wheels, can be characterized by the frequency ratio, f/N, which is the natural frequency of the blades of the wheel normalized by the allowable design speed (the shaft speed) of the air boost device, such as a turbocharger. Increasing both the full blade and splitter blade natural frequency of the wheel can reduce the risk of HCF failure. Higher frequencies can be generated by making the compressor wheel blades thicker, thus increasing the excitation energy that is required to overcome the increased stiffness of the blade. The damping capacity, inherent to the material, also plays a part in this feature. Contemporary aluminum compressor wheels have a fundamental mode frequency that is greater than four times the maximum operating speed of the turbocharger, i.e., >4.0 f/N, in order to avoid HCF failure. Testing performed by the Applicants indicated that aluminum compressor wheels subjected to a blade excitation test simulating a worst case installation failed in a short period of time, approximately 500,000 cycles, where the blade frequency ratio was below 4.0 f/N.

Historically, as pressure ratio demand has increased, the speed of the turbocharger has increased to generate the required pressure ratios. For a given wheel design (wheel in this case meaning blade design), the frequency ratio drops as the shaft speed increases. So for example, a 96 mm wheel which was capable of frequency ratios of 3.6 while running at 100,000 RPM, in the 1990s has had its speed increased to 125,000 RPM, in the 2000s, which reduces the frequency ratio to 2.9. This change is sufficient to produce many blade failures. As a result of this upwards creep of turbocharger speed, it has been a common practice to not only increase the basic design frequency ratio to greater than 4.0, but also to go back and upgrade older wheels to a higher frequency ratio to provide a greater factor of safety, so the trend has been to increase the frequency ratio repeatedly. The resistance to this increase in frequency ratio is the reduction of flow an efficiency which accompanies the increase in blade thickness to achieve the higher blade natural frequency.

To increase, or reduce the blade thickness it is important to understand the process. The blade beta distribution (generated by the CFD code) defines the curvature of the mean line, shown if FIG. 7A, 7B, 7C by the dotted line (7AM) for a linear blade, by the dotted line in FIG. 7B by the dotted line (7BM) for a pseudo-linear blade, and also shown in FIG. 7C as the dotted line (7CM) for a non-linear blade. The location of the pressure surfaces (7AP, 7BP, 7CP) and the suction surfaces (7As, 7BS, 7CS) is defined by the blade thickness relative to the mean line, for each slice of the compressor wheel. So when the blade frequency has to be altered up, or down, the offset from the mean line to the pressure, or suction, surfaces is appropriately modified. While the frequency can be also altered by subtle geometry changes the offset to the mean line is the more common method. The process for changing the frequency to make it lower is shown in FIG. 8. Here the old surfaces depicted by the dotted line (81) are moved towards the mean line (7AM) to produce a new thinner, lower frequency blade surface (82). The process for any other blade shape, such as those in FIGS. 8B and 8C is basically the same.

The result of the process above, illustrated in FIG. 8 is seen in FIG. 4. For the case of increasing the blade frequency of the compressor wheel, which is the normal progression, the original blade thickness (40) at a station close to the compressor wheel deck (27), at the contour side of the blade (25) is shown. To increase the blade thickness, the pressure and suction surfaces are displaced from the mean line to the new position (41) which is further from the mean line than the original blade thickness (40). This process is used for both main and for splitter blades. The leading edge (22L) and the contour surface (25) remain the same as naturally does the hub line, although the intersection of the blade pressure and suction surfaces with the hub line occurs at the greater distance form the mean line. By thickening these blades to raise the frequency, the volume between the blades is reduced, and it is through that volume, the airflow passes.

The accumulation of vibrational energy without an adequate dissipation mechanism can lead to increasing amplitude of vibration. In compressor wheel blades this can lead to overstress and material fatigue along the nodal boundaries.

Damping capacity is the relative ability of a material to absorb vibration. Sound is a form of vibration, at a range of audible frequencies. A typical cast brass bell has little damping and hence a long "ring down" period. If the bell were cast in concrete, or lead, then it would have high damping capacity and a minutely short "ring-down" period.

The relative damping capacity of the aluminum used for aluminum compressor wheels is 1.0. The relative damping capacity for Ti 6Al-4V is 1.6, so compressor wheels made from this heat treat of titanium have 60% more damping capacity than do the compressor wheels made from A354 aluminum. The chart in FIG. 5 depicts the ring-down period for a material with low damping capacity. The chart in FIG. 5B depicts the ring-down period for a titanium compressor wheel blade heat treated for maximum yield strength. The Y-axes depicts the amplitude of the vibration, recorded as a voltage by the instrumentation. The X-axis depicts the period of the vibration, which in both cases is 0.03 seconds. The Y axes scale is the same in both FIG. 5, and FIG. 6. FIG. 6 depicts test data from a titanium compressor wheel with a fully annealed heat treatment. The wheel is exactly the same design as the wheel used for the data in FIG. 5. It can be seen that the amplitude of the fully annealed titanium compressor wheel blade is considerably less than the amplitude of the fully heat treated titanium compressor wheel. The values for the fully heat treated wheel are a maximum amplitude of 0.793 volts. The maximum amplitude of the fully annealed wheel has a value of 0.010 volts. This translates to a reduction in amplitude of 98%. This data is easily recorded in a laboratory by plucking the compressor wheel blade with an exciter, such as a guitar pick, and recording the amplitude of the blade over a short period of time. Alternatively, a resonator such as a loud speaker could be placed next to the wheel and the frequency slowly increased or decreased until the wheel resonates in harmony with the speaker (like breaking a wine glass with the sound of a trumpet).

Typical turbocharger configurations have an inlet pipe with a 90 degree bend immediately in front of the compressor wheel. The bend can impart a pressure pulse to the wheel, which leads to blade excitation and a resulting HCF failure. In such configurations, aluminum compressor wheels have to be designed with high frequency ratios to be capable of withstanding input excitations and resist HCF failure. Many applications have filters directly attached to the compressor cover by struts and vortex shedding by the incoming airflow through the filter, to the compressor wheel is sufficient to excite the compressor wheel blades and set them on the way to failure.

These aluminum compressor wheels with increased frequency ratios have drawbacks. Because the increased blade natural frequency is generated by geometric stiffening of the blade the blade sections are naturally thicker. As a result, as shown in FIG. 3 one air passage, defined by the pressure side of one blade (22P), the suction side of the adjacent blade (22S), the blade leading edge (22L), the hub contour (24) on the inside and the compressor wall contour (25) on the opposite side, less the volume contained in the splitter blade, defined by the suction side of the splitter blade (23S), the pressure side of the splitter blade (23P), the hub and contour, contains less volume. As a result the airflow thorough the wheel is reduced. This total loss in flow means that for a given mass flow, the compressor wheel must rotate at a higher speed to generate the same pressure ratio. Higher speeds mean higher frictional losses, therefore lower efficiency. On the choke side of the map, the thicker blades will choke sooner. Surge is more complicated to predict since it depends on where the airflow stalls, in the inducer, or in the volute. If surge is the same then the range, from surge to choke is reduced, which is less desirable.

For the LCF aspect of compressor wheel life, the use of cast titanium wheels has recently been implemented. U.S. Pat. Nos. 6,629,556, 6,333,347, and 6,904,949 Decker et al teach the use and method of manufacture for cast titanium compressor wheels for turbochargers. The implementation of the cast titanium wheels in high performance turbochargers has resulted in a quantum improvement in compressor wheel life in these high performance turbochargers. While the mean geometry (and thus the blade surfaces) of the compressor wheel blades was altered to allow the compressor wheel wax patterns to be "pullable" from their wax production tools, no change was made to the "thickness" of the blade. The thickness of the blade is the dimension from the blade mean line to the pressure and suction surfaces at any point of the blade centerline.

There is thus a need for a titanium compressor wheel, and method of designing same, that is efficient and economical. There is a further need for a titanium compressor wheel, and method of designing same, having an acceptable operating life with thinner, lower frequency-ratio blade design, allowing higher flows and efficiencies at the same speed as that for the thick bladed version.

SUMMARY OF THE INVENTION

The exemplary embodiments described herein are directed to a titanium compressor wheel, and method of designing same, that is efficient, economical and has an acceptable operating life.

In one aspect of the invention, a compressor wheel for an air boost device is provided. The compressor wheel comprises a hub and a plurality of blades connected to the hub. The plurality of blades has a size and shape resulting in a ratio of natural frequency-to-maximum rotational speed of less than 4.0 and is made from a titanium alloy.

In another aspect of the invention, a turbocharger is provided comprising a compressor housing and a centrifugal compressor wheel positioned within the compressor housing. The compressor wheel has a compressor wheel hub with a plurality of blades attached to said hub. The plurality of blades has a size and shape resulting in a ratio of natural frequency-to-maximum rotational speed of less than 4.0 and are made from a titanium alloy.

In yet another aspect of the invention, a method of manufacturing a compressor wheel for a turbocharger is provided. The method comprises forming a hub with a plurality of blades attached thereto. The plurality of blades has a size and shape resulting in a ratio of natural frequency to maximum rotational speed of less than 4.0 and are made from a titanium alloy.

The foregoing has outlined rather broadly the more pertinent and important features of the present invention in order that the detailed description of the invention that follows may be better understood, and so that the present contribution to the art can be more fully appreciated. Additional features of the invention will be described hereinafter, which form the subject of the claims of the invention. It should be appreciated by those skilled in the art that the conception and the specific embodiments disclosed may be readily utilized as a basis for modifying or designing other compressor wheels for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

Figure 4:
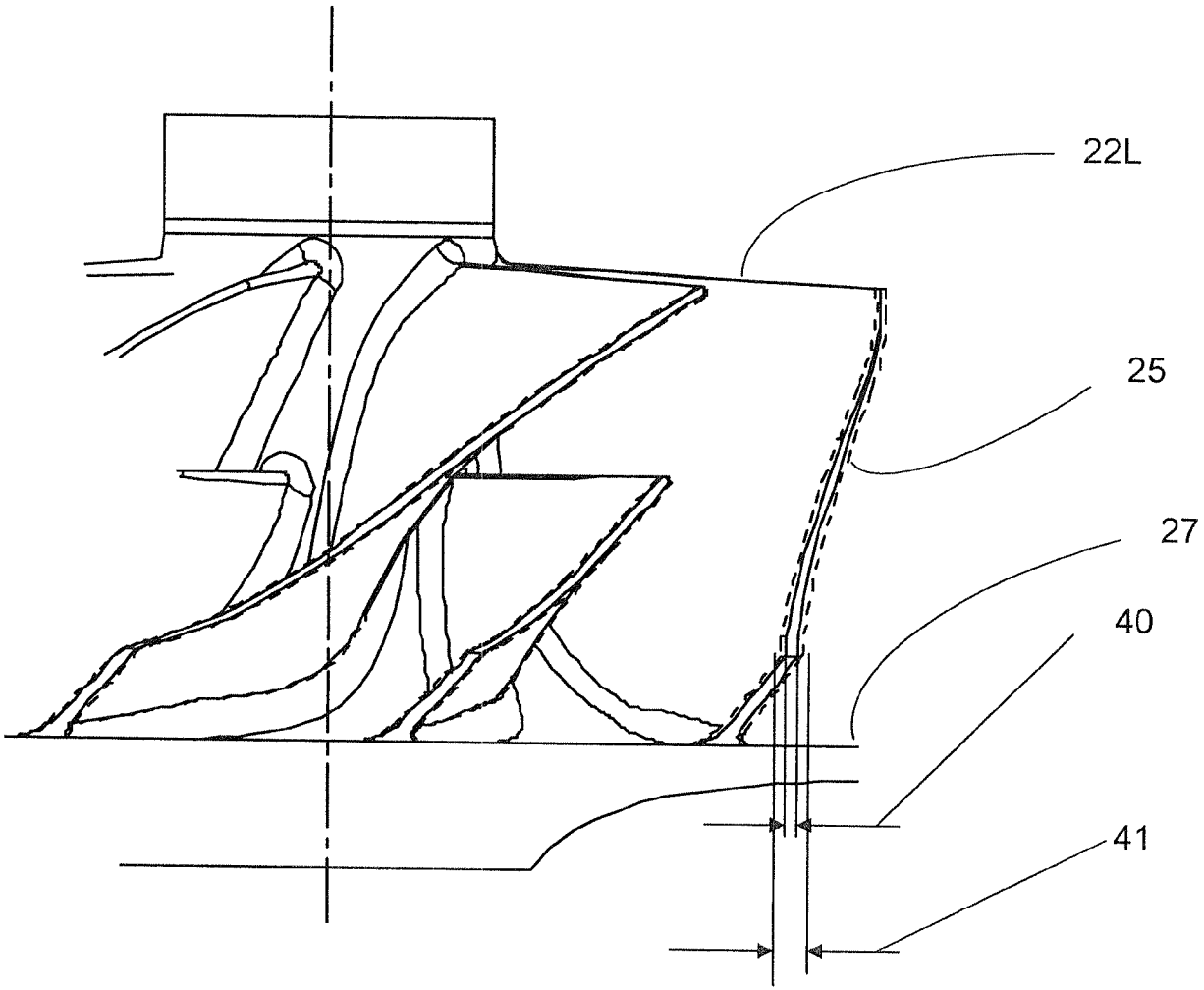
FIG. 4 shows a magnified view of the compressor wheel of FIG. 2 showing increased blade thickness.
Figure 5:
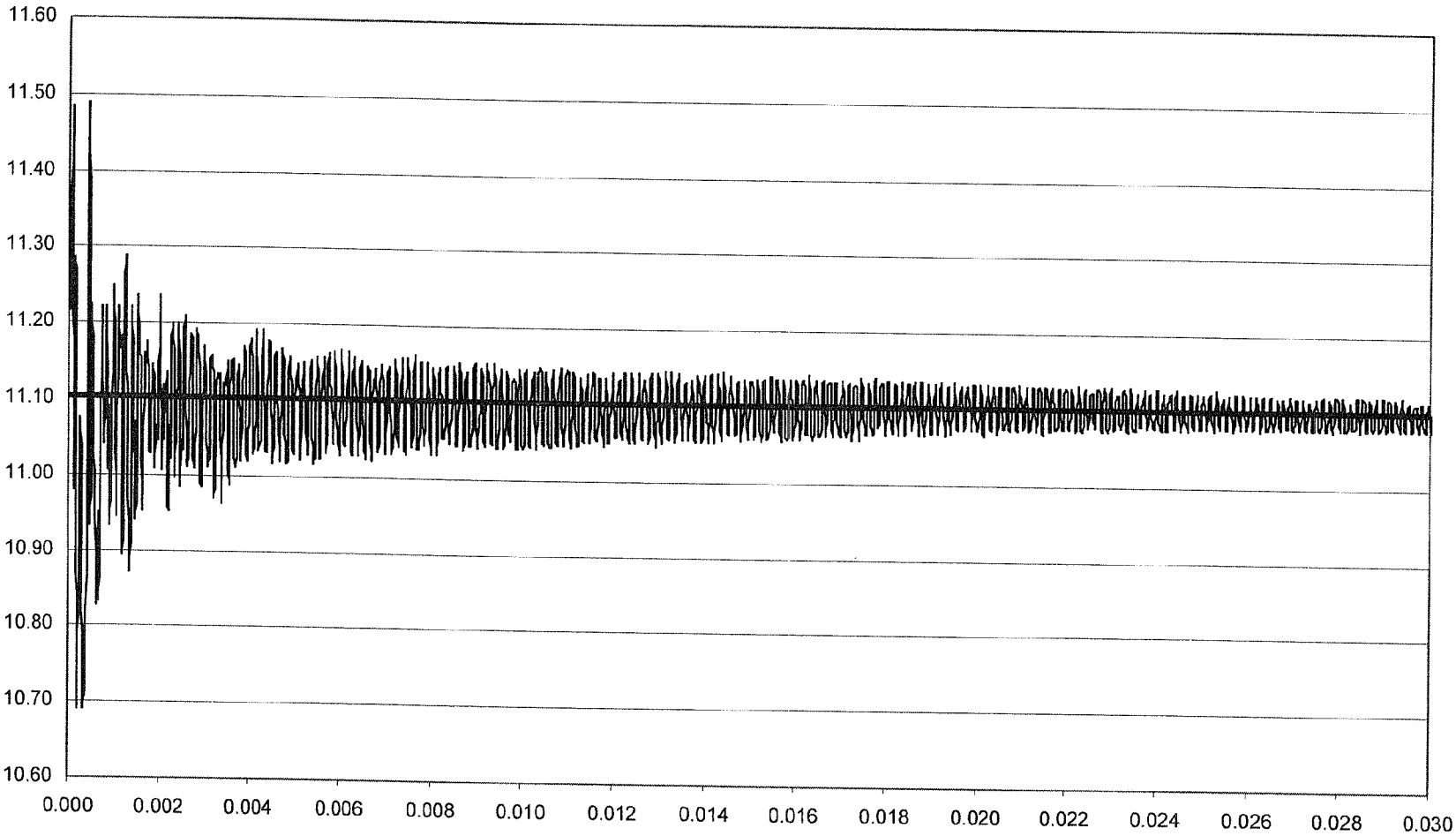
FIG. 5 shows the blade dynamic response plot for a fully heat treated wheel.
Figure 6:
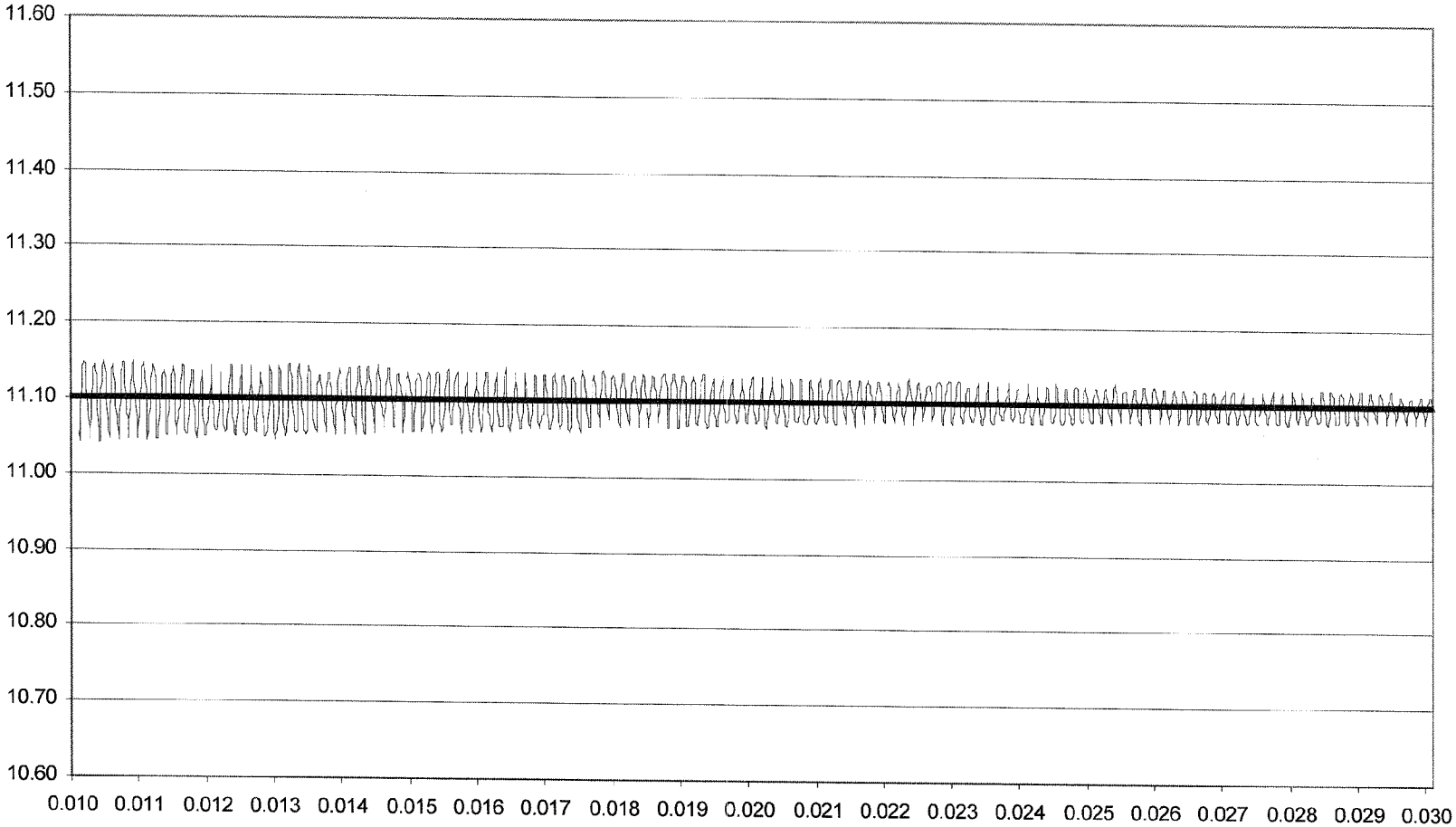
FIG. 6 shows the blade dynamic response plot for a fully annealed wheel.
Figures 7A, 7B, 7C:
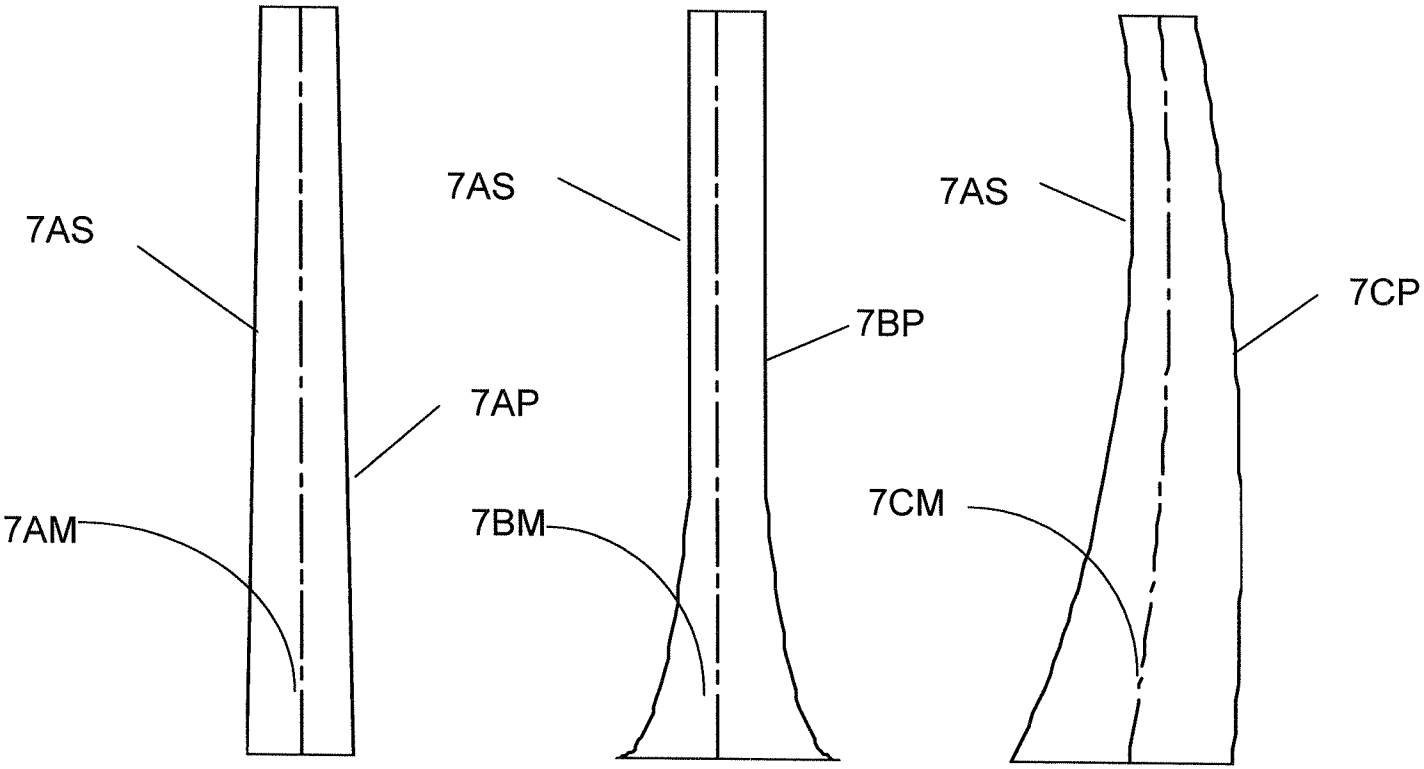
FIGS. 7A, 7B, and 7C depicts various blade shapes.
Figures 8A, 8B, 8C:
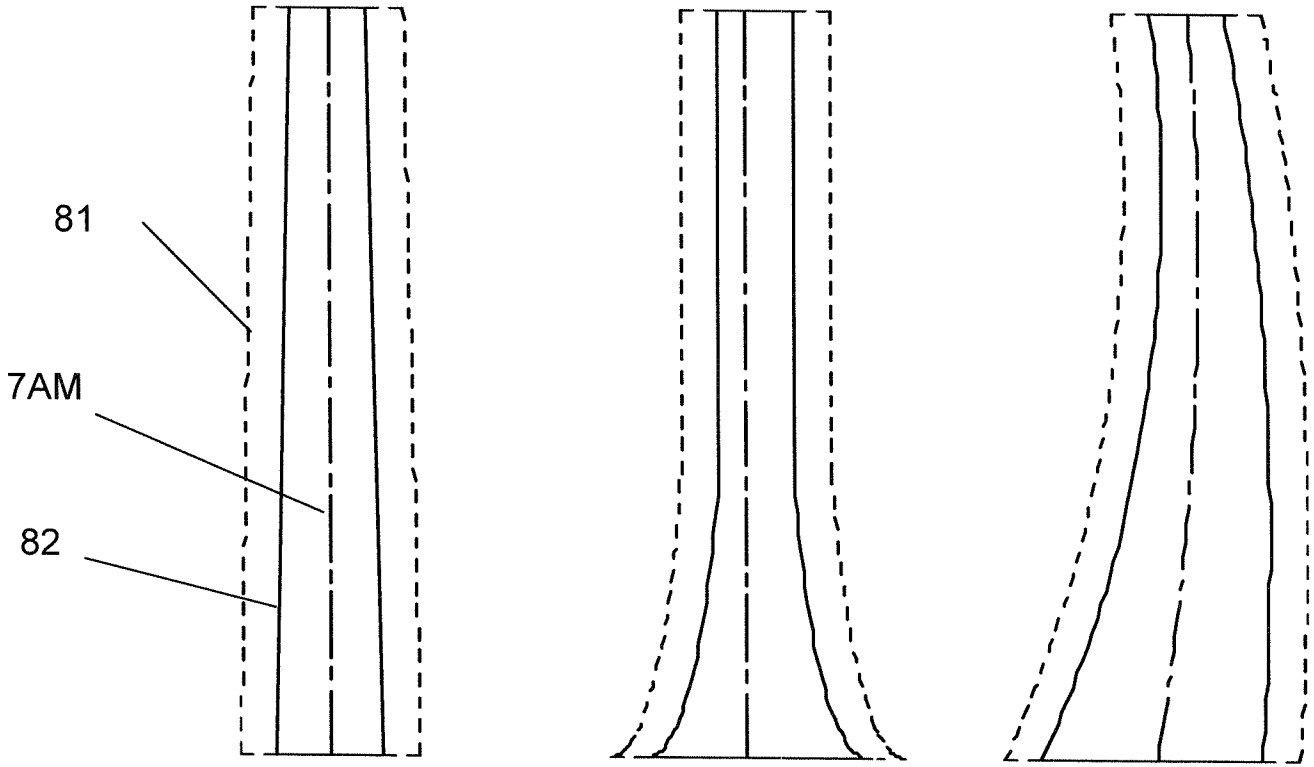
FIGS. 8A, 8B, and 8C depicts the blade shapes of FIGS. 7A, 7B, and 7C with alterations made to the thickness.

Embodiments of the invention are directed to a compressor wheel for an air boost device, such as a turbocharger, for delivery of a compressed fluid to an internal combustion engine. Aspects of the invention will be explained in connection with a compressor wheel for a turbocharger, but the detailed description is intended only as exemplary. Exemplary embodiments of the invention are shown in FIG. 4, but the present invention is not limited to the illustrated structure, application or composition.

Figure 1:
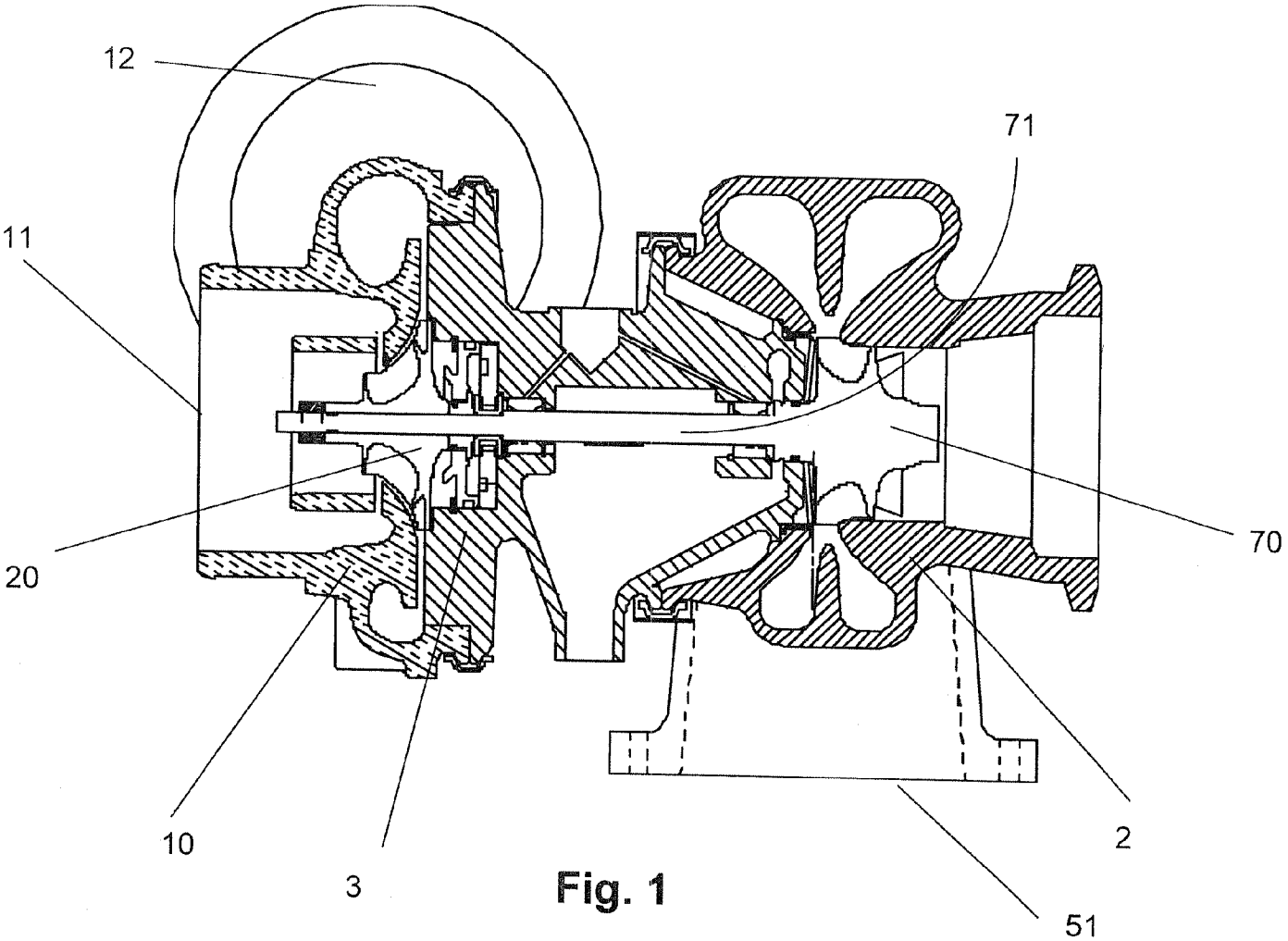
Fig. 1 Prior Art
FIG. 1 shows a section of a typical turbocharger.
Figure 2:
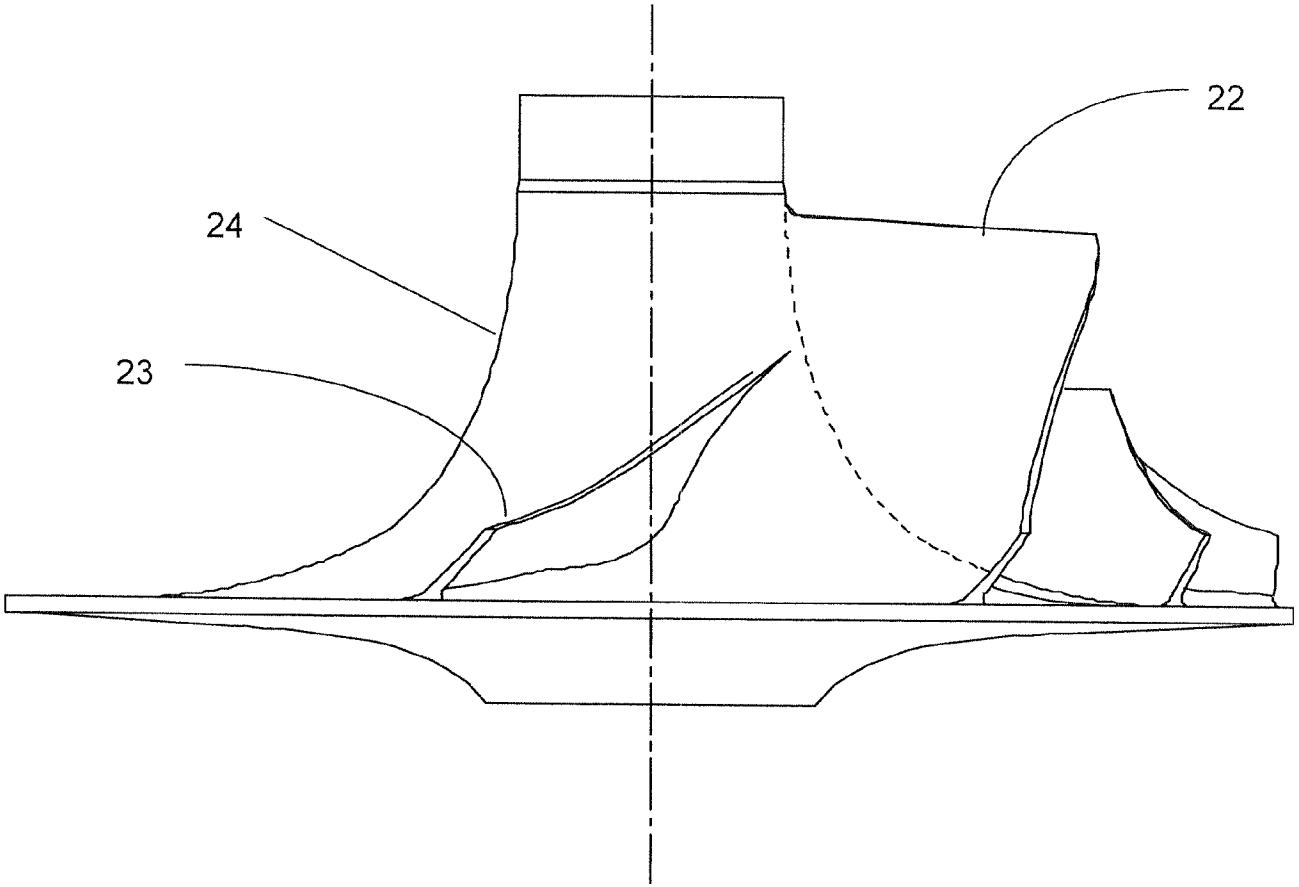
Fig. 2 Prior Art
FIG. 2 depicts the compressor wheel of FIG. 1 with some blades removed to show the hub line
Figure 3:
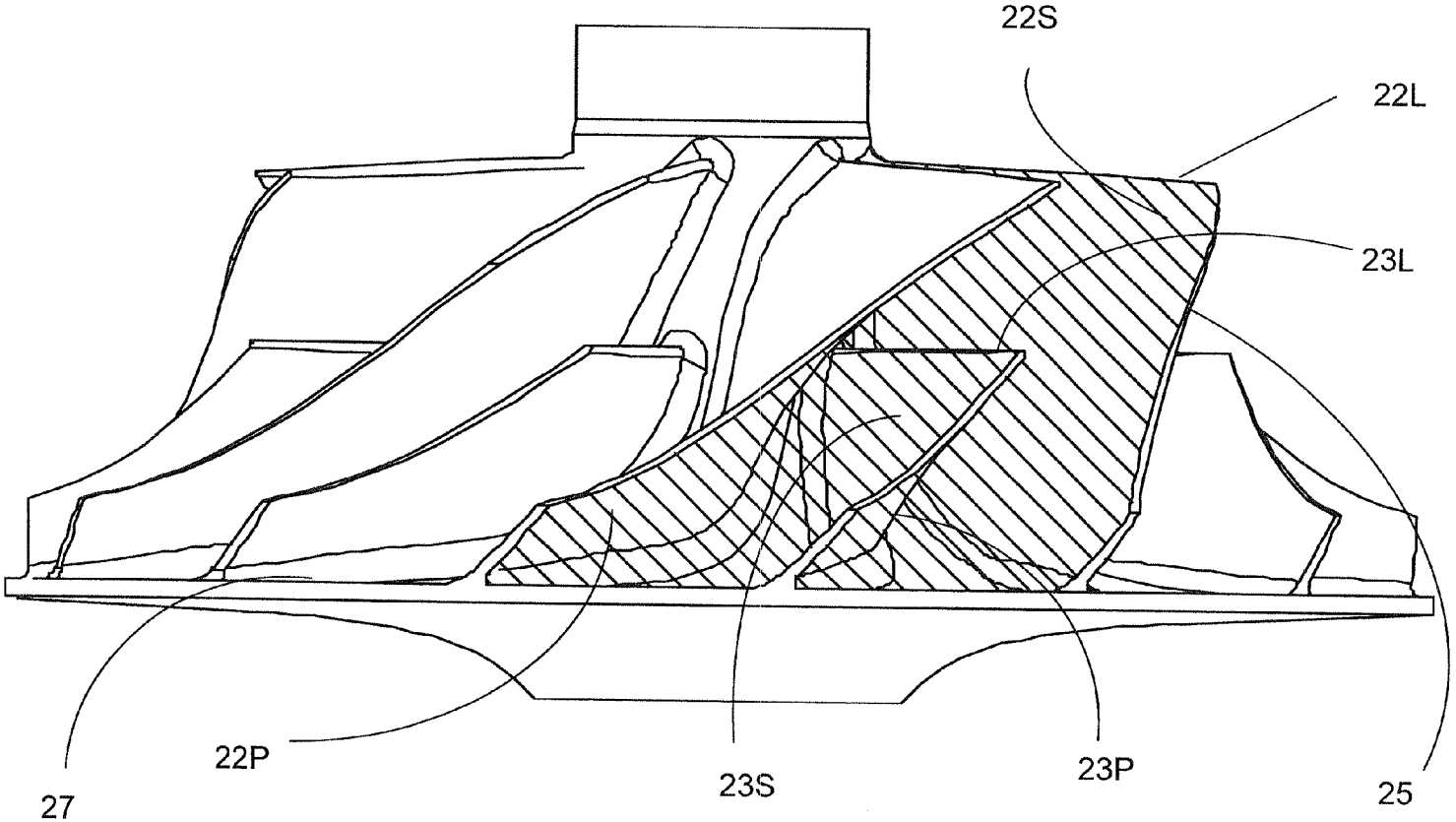
Fig. 3 Prior Art
FIG. 3 shows the compressor wheel shaded to show the flow volume.

To reduce the risk of HCF failure, the exemplary embodiment of a compressor wheel (20), shown in FIG. 1, uses a material having superior damping capacity. One such material is a titanium alloy. Compressor wheel (20) has a frequency ratio, f/N, under 4.0 using a heat treated, titanium alloy having superior damping capacity. By providing a size and shape of the blades, such as full blades (22) and splitter blades (23) connected to hub (24), that result in a frequency ratio less than 4.0, the compressor wheel has thinner blades and a less complex shape which results in lower cost and higher aerodynamic efficiency for the compressor wheel and stage.

The use of the titanium alloy compressor wheel having a frequency ratio, f/N, under 4.0 is preferred in that the wheel did not destructively respond under HCF conditions. These results are explained in detail in Example 1.

Example 1

A Compressor wheel (20) was subjected to HCF exacerbating conditions while monitoring for efficiencies and blade failure. Tests were performed using compressor wheels machined from annealed 6Al-4V titanium. An exciter in front of the compressor inlet (11) was used while the turbocharger was operated through a range of critical speeds that covered the range of natural frequencies for all of the full and splitter blades. The test continued for several estimated compressor wheel lifetimes. A marked improvement in efficiency of +1%, for the first wheel, and +2% for the second wheel, due to incrementally lower frequency-ratio designs of the compressor wheel, e.g., thinner blades, in addition to increased flow, was shown by the testing while the wheels were able to withstand the exacerbated HCF conditions for the test period. The results of testing of these compressor wheels of example 1 are shown in Table 1:

TABLE 1

| Blade Frequency/ Maximum Rotational Speed (f/N) | Peak Efficiency at $P_C = 3.0$ |
|---|---|
| 4.4 | Baseline |
| 3.3 | +1% |
| 2.3 | +2% |

These results of Example 1 are in contrast to the Applicants' testing of aluminum compressor wheels, of the same size and design, which were provided with blades having a size and shape resulting in a frequency-ratio of less than 4.0. The aluminum compressor wheels failed under the same exacerbated HCF conditions in only 5 hours, corresponding to about 500,000 cycles.

The particular size and shape of the blades of the compressor wheel (20), as well as the configuration of the wheel that results in a frequency ratio of less than 4.0 can be chosen by one of ordinary skill in the art. The particular process used to design and make the compressor wheel (20) with a frequency ratio of less than 4.0 can be chosen by one of ordinary skill in the art and can include casting, milling, machining and combinations thereof. Other materials, including other titanium alloys, such as, for example, a cast Titanium 4.9 weight percent Al, 3.7 weight percent V, 1.7 weight percent Cr, 0.37 weight percent Fe, 0.09 weight percent Si can also be used for the compressor wheel (20) having a frequency ratio of less than 4.0.

As shown in example 1, by choosing titanium alloys having appropriate mechanical features, resulting in a compressor wheel with a frequency ratio of less than 4.0, improvements in efficiency can be obtained while avoiding fatigue failure, including both HCF and LCF failure. The resulting airfoil shape of the blades of compressor wheel (20) is aerodynamically superior.

The low blade frequency titanium compressor wheel (20) has additional benefits such as the compressor discharge temperature being reduced, which reduces heat load into the intercooler and thus the vehicle. Backpressure on the engine can be reduced because the turbine does not have to run at a higher expansion ratio to drive the compressor. Lower exhaust gas temperature is needed to drive the turbo. Thus, in addition to performance, the benefits include both emissions and durability.

Although f/N (fundamental mode frequency relative to the maximum operating speed of the turbocharger) is explained above in terms of RPM, the inventive principal could also be explained in terms of compressor wheel blade tip speed. For example, it would be possible to use 560 m/sec which is becoming a standard, or even 600 m/sec, instead of RPM. In general the wheel operational limiting factor is really tip speed, even though it is more standard and accepted to use RPM in the formula for f/N. More specifically, RPM is only for a given wheel diameter, whereas the tip speed (e.g., *560 m/sec) is normalized for all wheels. The following formula is illustrative:

$$N(\text{shaft speed}) = \frac{60 * U_t(\text{tip speed}) * 1000}{Pi * D(\text{wheel dia})}$$

In one example, a a 96 mm wheel may be designed to run at 560 m/sec blade tip speed. The frequency ratio is defined as the natural first order blade frequency divided by the turbo shaft speed.

$f_n/N$

Turbocharger rotating components are design to a normalized tip speed (often 560 m/sec). The reason for this is that many sizes of wheels are used so the shaft speed changes for a given diameter of the wheel (supposing the wheel speed max is a constant), which causes a lot of confusion, whereas the tip speed is a given for all of a family of wheels. The formula is:

$$N = \frac{60 * U_t * 1000}{\Pi * D}$$

Where N is the shaft speed $U_t$ is the design (or sometimes application) tip speed D is the wheel diameter in mm.

So for a 96 mm wheel, with a mean first order blade frequency of 6141 hertz, and a design speed of 560 m/sec The wheel speed will be:

$$\frac{60 * 560 * 1000}{3.1416 * 96} = 111,408 \text{ RPM}$$

And the blade frequency ratio will be

6141*60/111,408=3.3

Although a compressor wheel has been described herein with great detail with respect to an embodiment suitable for the automobile or truck industry, it will be readily apparent that the compressor wheel and the process for production thereof are suitable for use in a number of other applications, such as fuel cell powered vehicles. Although this invention has been described in its preferred form with a certain of particularity with respect to an automotive internal combustion compressor wheel, it is understood that the present disclosure of the preferred form has been made only by way of example and that numerous changes in the details of structures and the composition of the combination may be resorted to without departing from the spirit and scope of the invention.

Now that the invention has been described,

We claim:

1. A method for designing a compressor wheel comprising:

selecting a desired maximum rotational operating speed (RPM) for a compressor wheel (20) for an air boost device, the compressor wheel (20) comprising a hub (24) and a plurality of blades comprising full (22) and optionally splitter (23) blades connected to the hub (24), selecting the material for the compressor wheel based on whether the material has a high damping capacity, designing the size and shape of the full blades (22) so as to have a ratio (f/N) of natural frequency of the blades to selected maximum rotational speed of less than 4.0.

2. The method of claim 1, wherein the material is a titanium alloy.

3. The method of claim 2, wherein the titanium alloy is annealed 6Al4V titanium.

4. The method of claim 2, wherein the titanium alloy comprises 4.9% Al, 3.7% V, 1.7% Cr, 0.37% Fe, and 0.09% Si.

5. The method of claim 1, wherein the ratio (f/N) is less than or equal to 3.3.

6. The method of claim 1, wherein the ratio (f/N) is less than or equal to 2.3.

7. The method of claim 1, wherein the plurality of blades (22, 23) comprises a plurality of full blades (22) and a plurality of splitter blades (23), and wherein said ratio (f/N) of natural frequency of the splitter blades is 4.0 or less.

8. A compressor wheel (20) for an air boost device, the compressor wheel (20) comprising a hub (24) and a plurality of blades (22, 23) connected to the hub (24), the plurality of blades (22, 23) being made from a titanium alloy and having a size and shape resulting in a ratio (f/N) of natural frequency to maximum rotational speed of less than 4.0.

9. A turbocharger comprising:

a compressor housing (10); and a centrifugal compressor wheel (20) positioned within said compressor housing (10) and having a compressor wheel hub (24) with a plurality of blades (22, 23) attached to said hub (24), wherein the plurality of blades (22, 23) are made from a titanium alloy and have a size and shape resulting in a ratio (f/N) of natural frequency to maximum rotational speed of less than 4.0.

10. The turbocharger of claim 9, wherein the ratio (f/N) is less than or equal to 3.3.

11. The turbocharger of claim 9, wherein the ratio (f/N) is less than or equal to 2.3.

* * * * *